United States Patent [19]

Winckler

[11] Patent Number: 4,689,947

[45] Date of Patent: Sep. 1, 1987

[54] APPARATUS AND METHOD FOR REDUCING BROKEN FIBERS ON THE SURFACE OF A CARBON FIBER YARN BUNDLE

[75] Inventor: Steven J. Winckler, Troy, N.Y.

[73] Assignee: E. I. Du Pont de Nemours and Company, Wilmington, Del.

[21] Appl. No.: 898,903

[22] Filed: Aug. 19, 1986

[51] Int. Cl.[4] ..... D02J 3/12; D02J 3/14; D02J 7/00; D01H 13/30

[52] U.S. Cl. ..... 57/304; 19/263; 28/224; 28/228; 57/305; 83/909; 225/1; 225/93; 423/447.1

[58] Field of Search ..... 57/304–306; 19/262–265; 83/24, 436, 909, 913; 225/1, 6, 93; 28/222–235

[56] References Cited

U.S. PATENT DOCUMENTS

| | | | |
|---|---|---|---|
| 908,341 | 12/1908 | Shipp | 57/304 X |
| 2,144,767 | 1/1939 | McCallum | 28/224 X |
| 2,266,899 | 12/1941 | Owens | 28/228 |
| 2,266,900 | 12/1941 | Owens et al. | 28/228 |
| 2,425,576 | 8/1947 | Thoma | 57/304 X |
| 2,763,913 | 9/1956 | Furst | 28/229 |
| 2,928,140 | 3/1960 | Powell, Jr. | 19/263 |
| 3,755,849 | 9/1973 | Fink | 57/304 X |
| 4,351,816 | 9/1982 | Schultz | 423/447.4 |

*Primary Examiner*—John Petrakes

[57] ABSTRACT

A method for reducing broken fibers on the surface of a carbon fiber bundle involves passing the yarn past a suction nozzle having an extended trailing edge which impacts the broken fibers as they pass the slot breaking off the fibers. The broken fibers are transported to a disposal station. The differential in elevation of the leading and trailing edges of the intake slot of the nozzle provide an exposed impacting edge.

5 Claims, 4 Drawing Figures

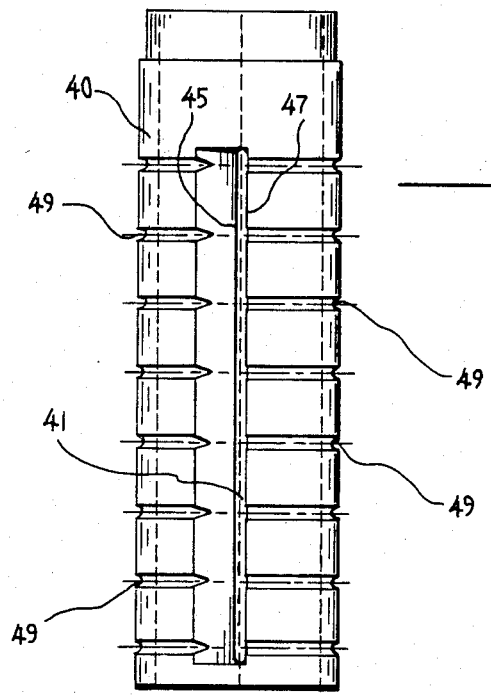
Fig. 3
Fig. 4
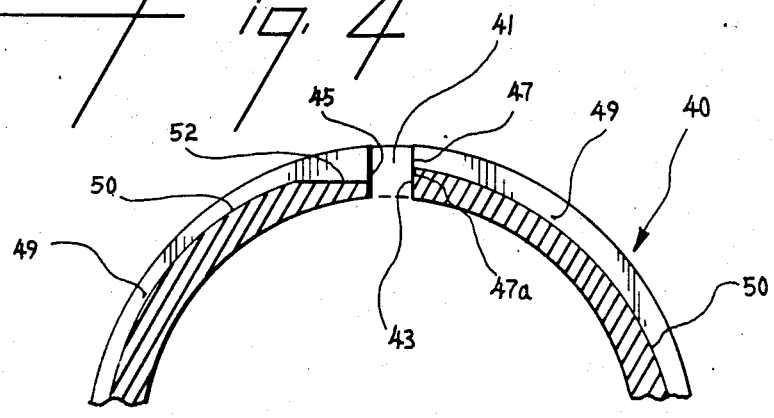

APPARATUS AND METHOD FOR REDUCING BROKEN FIBERS ON THE SURFACE OF A CARBON FIBER YARN BUNDLE

BACKGROUND OF THE INVENTION

This invention relates to a carbon yarn and more particularly to a method for reducing broken fibers on the surface of the carbon fiber yarn bundle.

Generally, the conventional commercial process for producing a mesophase pitch derived carbon yarn includes the steps of forming a plurality of mesophase pitch fibers to define a mesophase pitch yarn, thermosetting the mesophase pitch yarn to produce a thermoset yarn, and thereafter subjecting the thermoset yarn to a thread-line heat treatment in an inert atmosphere to pyrolyze and carbonize the thermoset yarn and produce the carbon yarn. U.S. Pat. No. 4,351,816 to Schulz describes a known process for producing carbon yarn and recites the problems associated with surface defects such as broken fibers and discloses a method for providing a carbon yarn substantially free of frays or broken fibers. U.S. patent application Ser. No. 747,879 of common assignee filed June 24, 1985, now U.S. Pat. No. 4,624,102, discloses operation of a liquid applicator useful in reducing broken fibers on a carbon yarn.

SUMMARY OF THE INVENTION

The current invention contemplates both breaking off broken fibers on the surface of a carbon fiber yarn bundle by the use of an apparatus which provides an air flow at approximately 90° to the longitudinal axis of the yarn bundle which initiates the process by pulling the broken fibers away from the bundle. The movement of the bundle in its path then pulls the broken fiber against a sharp edge cutting the fiber off close to the bundle. The cut-off broken fibers are then transported by the air flow to a disposal station.

The apparatus includes a suction nozzle located adjacent to the path of travel of the yarn bundle. The nozzel has a slot-shaped intake passage formed of a continuous wall having leading and trailing edges. The trailing edge is a sharp edge vertically displaced from the leading edge to form an extended wall of the passage. Grooves are located on the surface of the nozzle to guide the yarn across the slot.

BRIEF DESCRIPTION OF THE DRAWING

FIG. 3 is a top view of one of the nozzles of FIG. 2.

FIG. 4 is an enlarged view of one nozzle of FIG. 2.

DETAILED DESCRIPTION OF THE PREFERRED EMBODIMENT

Figure 1:
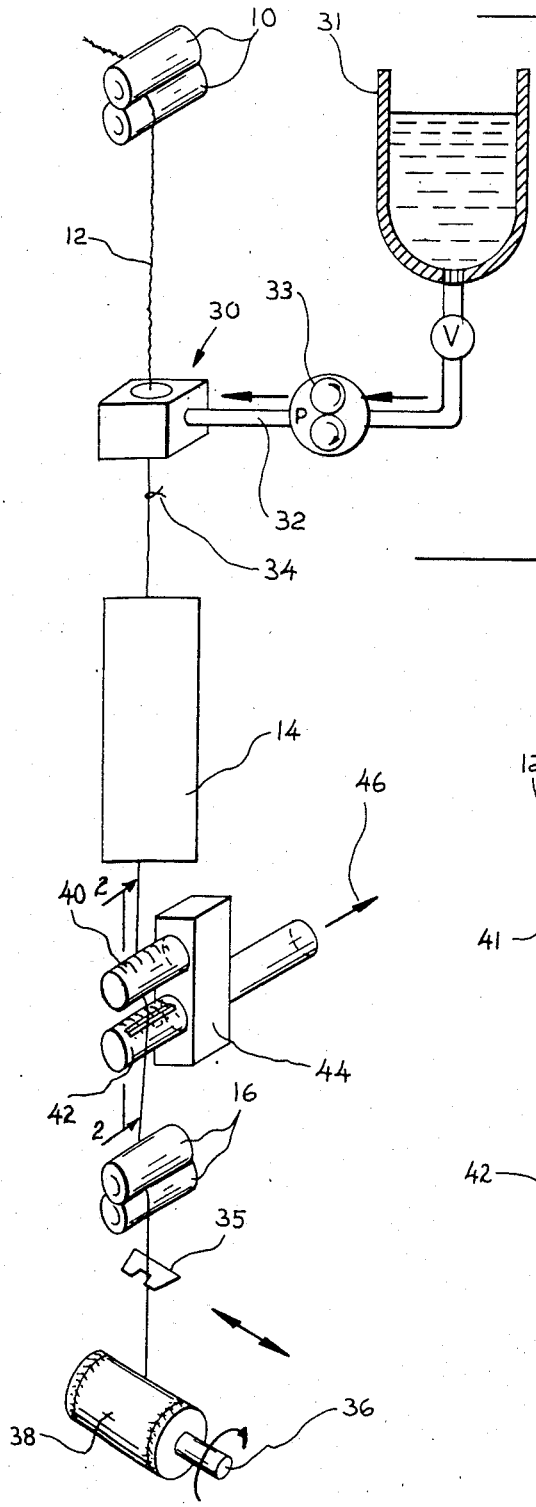
FIG. 1 is a schematic drawing showing use of the suction nozzle of this invention in a carbon yarn handling operation.

The method chosen for purposes of illustration in FIG. 1 includes a carbon yarn fiber bundle 12 forwarded at a constant speed by rolls 10 from a source (not shown). Carbon yarns of this type are disclosed in U.S. Pat. No. 4,351,816 and include surface defects in the form of broken fibers. Yarn from rolls 10 then passes through liquid applicator 30 into which a metered amount of liquid is pumped through fluid inlet pipe 32 in a continuous stream from source 31 by means of a gear pump 33. The liquid is supplied to applicator 30 at a sufficiently high flow rate to provide a swirling rimming flow within the interior passage of the applicator and the yarn bundle is contacted by the swirling rimming flow. The yarn as it leaves the applicator 30 is directed through a fixed guide 34 into a drying oven 14 after which it encounters a pair of suction nozzles 40,42 connected to a manifold 44 which is connected to a source of vacuum indicated by flow arrow 46. The yarn then encounters another pair of rolls 16 which are driven at a sufficiently higher speed than rolls 10 to provide enough yarn tension to center the yarn axially in the applicator and to overcome any tendencies for the yarn bundle to twist in the applicator. The yarn is then directed through a traversing guide 35 onto a rotating core 36 to form a package 38.

The liquid applicator 30 may be of a known type such as an air jet used to exert a torque on a moving threadline to false twist textile yarns. In its simplest embodiment, the fluid jet twister comprises a metal block having a tubular yarn passage which is a smooth, curved, concave surface in combination with one fluid conduit positioned to direct a stream of liquid finish circumferentially about the inner periphery of the curved, concave surface so that the yarn as it passes through the jet is contacted around its periphery by the liquid. Such jets are disclosed in FIGS. 5 and 6 of U.S. Pat. No. 3,009,309.

Figure 2:
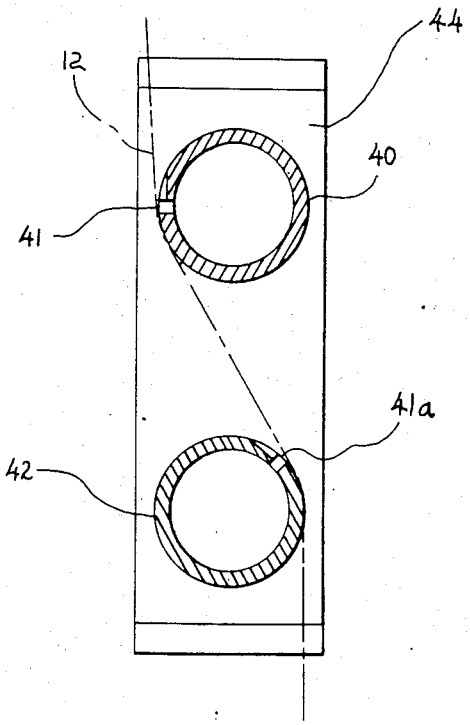
FIG. 2 is an enlarged view partially in section of the suction nozzle of this invention taken along line 2—2 of FIG. 1.

Referring now to FIGS. 2, 3 and 4 the nozzle 40 is seen to comprise a tubular element and to have a slot shaped intake passage 41 formed of a continuous wall 43 and has leading and trailing edges 45 and 47 respectively. As can be seen edge 47 extends vertically above edge 45 to form an extended wall **47*a* of the passage. Grooves 49 in the surface of nozzle 40 serve as the means to guide the yarn across the nozzle 41. Nozzle 42 is a duplicate of nozzle 40 however its intake passage 41*a* is located about 225 angular degrees from slot 41 for the purpose of removing broken fibers on another portion of the yarn. The yarn guiding surface of the nozzle approaching to the leading edge of the slot comprises successive curved and straight lengths 50 and 52** respectively.

The following example illustrates an embodiment of the invention but is not intended to be limiting.

EXAMPLE

A carbon yarn bundle consisting of 3000 fibers having numerous broken fibers extending from its surface is processed according to FIG. 1 wherein the yarn is passed from driven rolls 10 at four (4) feet per minute into the yarn passageway of a fluid applicator of the type shown in FIG. 1 having a cylindrical passage 0.250 inch in diameter and a length of 0.125 inch. A liquid comprising a 1 percent epoxy resin in water is pumped at a rate of 250 cc/minute (about $3\frac{3}{4}$ gallons per hour) into the fluid conduit 32 of the applicator. Measurements made on the yarn indicated that the tension on the running threadline is 150 grams. From the applicator the yarn passes through dryer 14 to be dried at a temperature of 350° C. for 4 minutes and then past the nozzles 40,42 which have a vacuum applied of about $33 \pm 5$ inches.

Inspection of the treated yarn reveals that it is substantially free of broken fibers extending from the surface of the yarn bundle whereas a control yarn wherein the applicator was either bypassed or the flow of liquid discontinued, showed numerous broken fibers.

I claim:

1. In an apparatus for removing broken fibers from a multifilament carbon yarn moving in a path that includes a suction nozzle coupled to a source of suction, said nozzle being located adjacent said path, the improvement comprising: said nozzle having a slot-shaped intake passage substantially perpendicular to said path and in communication with said source of suction, said slot-shaped intake passage being formed of a continuous wall and having leading and trailing edges, said trailing edge being a sharp edge vertically displaced from said leading edge to form an extended wall of said passage; and means for guiding said yarn close to said trailing edge.

2. The apparatus of claim 1, said means for guiding said yarn being a surface curving downwardly away from said trailing edge, said surface having elongated grooves therein to position said yarn.

3. The apparatus of claim 1, there being at least two nozzles located adjacent each other said slots being about 180 angular degrees apart and there being a yarn guiding surface having successive curved and flat lengths approaching said leading edge of each slot with yarn guiding slots in the curved lengths.

4. A method for reducing broken fibers on a portion of the surface of a carbon fiber yarn having a coating thereon comprising: forwarding the carbon yarn in a path past a nozzle having a slot shaped intake passage with a leading edge and a sharp trailing edge vertically displaced from said leading edge, said path being substantially perpendicular to said nozzle; applying a sufficient suction to said nozzle to draw the ends of the broken fibers toward said nozzle; and impacting said broken fibers against said sharp trailing edge to cut said broken fibers from said yarn.

5. The method of claim 4, including the step of repeating said method on another portion of the surface of said yarn.

* * * * *